United States Patent [19]

Haws et al.

[11] Patent Number: 4,993,434

[45] Date of Patent: Feb. 19, 1991

[54] CIGARETTE RODS WITH LIQUID FLAVOR CENTERS

[75] Inventors: Lewis A. Haws; Jose G. Nepomuceno, both of Richmond, Va.

[73] Assignee: Philip Morris Incorporated, New York, N.Y.

[21] Appl. No.: 374,007

[22] Filed: Jun. 29, 1989

[51] Int. Cl.[5] ..... A24C 5/14

[52] U.S. Cl. ..... 131/79; 131/31; 131/62; 131/64.1; 131/64.2; 131/335

[58] Field of Search ..... 131/31, 62, 64.1, 64.2, 131/79, 335, 84.1

[56] References Cited

U.S. PATENT DOCUMENTS

| | | | |
|---|---|---|---|
| 3,006,347 | 10/1961 | Keaton . | |
| 3,144,024 | 8/1964 | Eichwald et al. . | |
| 3,162,199 | 12/1964 | Moll, Jr. . | |
| 3,550,598 | 12/1970 | McGlumphy et al. . | |
| 3,817,258 | 6/1974 | Ernow . | |
| 4,236,532 | 12/1980 | Schweizer et al. . | |
| 4,281,671 | 8/1981 | Bynre et al. . | |
| 4,347,855 | 9/1982 | Lanzillotti et al. . | |
| 4,365,585 | 12/1982 | Naylor et al. . | |
| 4,409,995 | 10/1983 | Nichols . | |
| 4,449,541 | 5/1984 | Mays et al. . | |
| 4,452,260 | 6/1984 | Porenski et al. . | |
| 4,472,224 | 9/1984 | Pryor . | |
| 4,476,807 | 10/1989 | Pryor . | |
| 4,510,950 | 4/1985 | Keritsis et al. . | |
| 4,525,385 | 6/1985 | Pryor . | |
| 4,549,875 | 10/1985 | Pryor . | |
| 4,619,276 | 10/1986 | Albertson et al. | 131/31 |
| 4,632,131 | 12/1986 | Burnett et al. . | |
| 4,715,390 | 12/1987 | Nichols et al. . | |
| 4,729,391 | 3/1988 | Woods et al. . | |
| 4,763,672 | 8/1988 | Gregory, III . | |
| 4,768,526 | 9/1988 | Pryor . | |
| 4,781,203 | 11/1988 | La Hue | 131/31 |
| 4,899,765 | 2/1990 | Davis et al. . | |
| 4,913,166 | 4/1990 | Christensson et al. . | |

FOREIGN PATENT DOCUMENTS

| | | | |
|---|---|---|---|
| 2254063 | 5/1973 | Fed. Rep. of Germany | 131/31 |
| 2335179 | 2/1974 | Fed. Rep. of Germany . | |
| 3821677 A1 | 1/1990 | Fed. Rep. of Germany . | |
| 3844620 | 2/1990 | Fed. Rep. of Germany . | |

*Primary Examiner*—V. Millin

*Attorney, Agent, or Firm*—Robert M. Isackson; Gerard A. deBlasi

[57] ABSTRACT

Methods and apparatus for applying liquid strands containing additives to cigarette rods. Liquid is extruded to form one or more strands that are applied to loose tobacco filler in the chimney section of a conventional cigarette maker. The liquid has a viscosity that prevents it from soaking through the tobacco and contacting the cigarette maker or the cigarette wrapper. Additives to the liquid strands include flavorants, burn inhibitors, and burn accelerators.

23 Claims, 3 Drawing Sheets

CIGARETTE RODS WITH LIQUID FLAVOR CENTERS

BACKGROUND OF THE INVENTION

This invention relates to smoking articles, and more particularly to smoking articles including liquid flavor strands, and the apparatus and process for making such articles.

The addition of flavorants and other additives to tobacco filler during cigarette manufacturing is a common practice. It is important that the additives are applied in consistent concentrations throughout the smoking article, such that each article has the same burn and flavor characteristics from puff to puff. However, the known techniques suffer from various technical problems.

Additives may be applied to tobacco filler by treating the filler prior to sending the tobacco to the cigarette-making machine. However, it is difficult to achieve a uniform application of additives by spraying bulk tobacco. Also, because many additives are volatile compounds, some of the flavoring may escape from the tobacco during processing.

Certain additives, due to their viscous properties, must be sprayed onto the tobacco filler in very dilute forms. However, the solvent (typically aqueous) used to dilute the additives tends to disperse and saturate the tobacco, requiring an additional drying load. Also, some desirable additives applied to the tobacco are sticky and may gum up or contaminate the cigarette maker during the cigarette making process. Liquid additives applied to the tobacco to provide a uniform surface coating on the tobacco particles can potentially stain the paper cigarette wrapper of the finished cigarette.

Additives may be applied to tobacco filler using a foaming process. By using air to dilute the additive (instead of water or other liquid solvents) the foaming process allows even application of the additives to the tobacco filler without staining the paper cigarette wrapper, but the liquid to be foamed must have a relatively low viscosity. Hence, any flavorants added using the foaming process must form a relatively non-viscous solution.

In view of the foregoing, it is an object of this invention to provide a method for incorporating selected materials into a cigarette rod so that the materials are applied in consistent concentrations throughout the length of the article.

It is another object of this invention to provide for incorporating selected materials into cigarettes at the rod forming stage in the manufacturing process.

It is another object of this invention to provide a method for selectively varying, along the length of the rod, the concentrations of the materials added to a cigarette.

It is yet another object of this invention to provide for incorporating selected materials into cigarette rods during the manufacturing process without using excessive amounts of solvents.

SUMMARY OF THE INVENTION

The present invention involves forming a strand of liquid material within the tobacco filler. The liquid strand comprises materials of a viscosity sufficient to prevent the liquid from passing through the tobacco filler which surrounds it, thereby minimizing the likelihood of the liquid staining the paper wrapper. In the preferred embodiment, the liquid strand extends down the length of the cigarette rod, having a consistent diameter throughout its length. In this manner, the material is uniformly distributed along the length of the rod, giving the cigarette consistent smoking characteristics from puff to puff.

The invention provides for adding the liquid strand to the cigarette rod as the rod is being formed in the chimney of a conventional cigarette maker, preferably at a location prior to the tobacco leaving the vacuum belt. The, cigarette maker is thus modified to include one or more nozzles for passing the liquid material into the stream of moving tobacco, so that the strand will be completely surrounded by tobacco filler as the cigarette rod is formed. The rod is later compressed and wrapped with paper in a conventional manner.

A variety of materials may be added to the liquid strand, including flavorants and burn modifiers. The materials may be dissolved in the liquid strand or may be added to the liquid in solid form to create a slurry. Alternatively, the liquid strand may be formed of pure materials.

Further features of the invention, its nature and various advantages will be more apparent from the accompanying drawings and the following detailed description of the preferred embodiments.

DETAILED DESCRIPTION OF THE INVENTION

Figure 1:
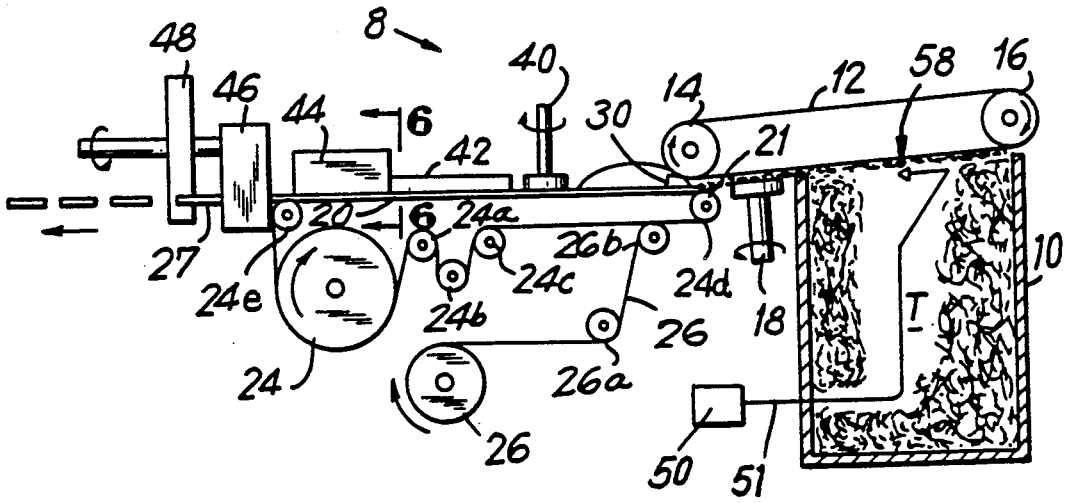
FIG. 1 is a simplified schematic illustration of a cigarette making machine suitable for use in accordance with the present invention.
Figure 2:
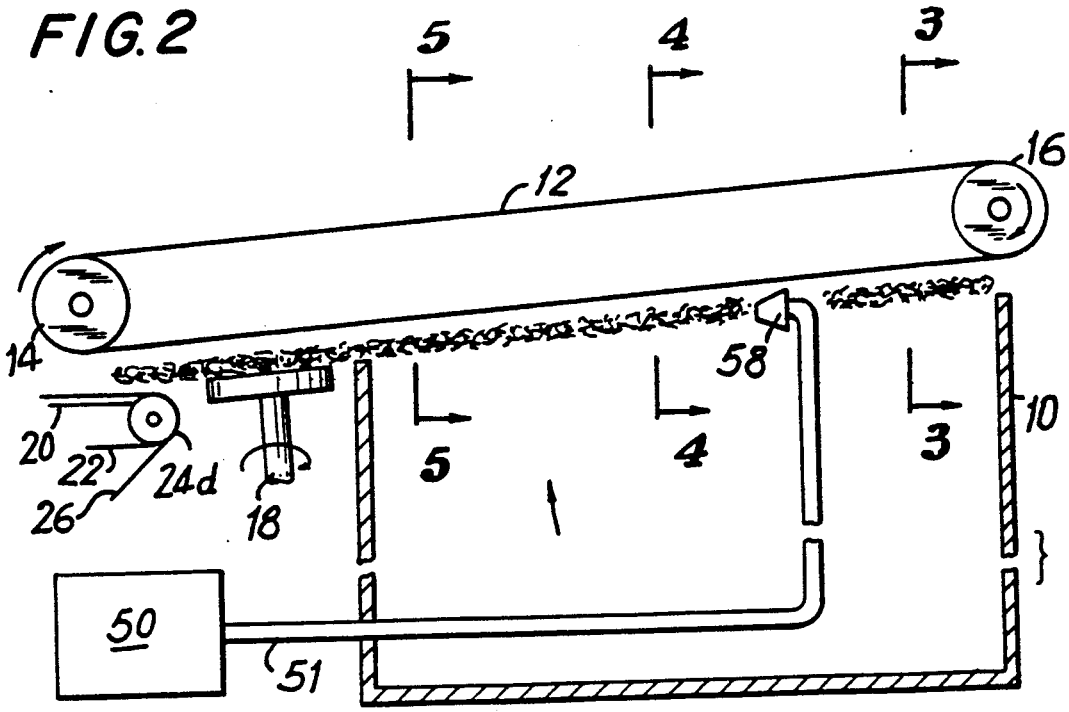
FIG. 2 is side view of the chimney section of the cigarette making machine of FIG. 1.

Referring to FIGS. 1 and 2, the apparatus used to manufacture cigarettes with liquid strands in accordance with the present invention is shown. In the preferred embodiment, the apparatus is similar to the apparatus disclosed in U.S. Pat. No. 4,619,276, and is designated generally by reference numeral 8. To produce cigarettes, tobacco T is blown from chimney 10 onto a perforated vacuum belt 12, driven by roller 14. As belt 12 advances across chimney 10, from roller 16 toward roller 14, tobacco accumulates on belt 12 so that the desired amount of tobacco for the smoking article has accumulated at roller 14. Substantially no tobacco is on belt 12 at roller 16.

In accordance with the present invention, a liquid strand is preferably placed substantially in the center of the tobacco rod accumulating in the guide rails 62 (shown in detail in FIGS. 3–5) surrounding belt 12. The liquid is pumped from storage means 50 through pipe 51, and out through nozzle 58. The liquid strand is initially placed against tobacco which has accumulated against belt 12, in guide rails 62, and is covered by additional tobacco filler as belt 12 travels toward ecreteur or trimmer knife assembly 18. Belt 12 carries the tobacco past trimmer knife assembly 18 which trim excess tobacco from the newly-formed rod. The tobacco rod then separates from belt 12, and is deposited on paper 26.

To the left of roller 14, a garniture 20 extends longitudinally from roller **24*d* to roller 24*e*. Garniture 20 includes a channel having a substantially semi-circular shape. Garniture belt 22 travels through this channel, driven by drive wheel 24 over idler rollers 24*a*–24*e*. Cigarette paper 26 is drawn from a supply roll, over rollers 26*a* and 26*b*, and onto garniture tape 22. Garniture 20 imparts a substantially semi-circular shape to paper 26. The liquid-filled tobacco rod from belt 12 is disposed in the substantially semi-circular cavity of paper 26**.

The loosely packed tobacco rod and paper 26 are conveyed by garniture tape 22 to the short tongue 30. Short tongue 30 includes a compression foot which compresses the tobacco rod and paper 26 into a substantially cylindrical shape, forming rod 27. A length of paper 26 extends tangentially from rod 27. Glue gun 40 applies adhesive to this extended length of paper, and folder unit 42 folds the pasted length over the rod to form a cylinder. Heat unit 44 heat seals rod 27. The continuous rod passes through a density sensor 46 and is cut into cigarettes by rod cut-off mechanism 48.

Figure 3:
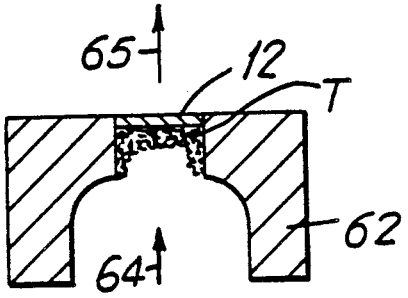
FIG. 3 is a cross-sectional view taken along line 3—3 of FIG. 2.

Referring to FIGS. 2 and 3, air, carrying loose tobacco T, is blown in the direction indicated by arrow 64. The air passes through perforated belt 12 (as indicated by arrow 65), creating a vacuum which holds the loose tobacco filler against belt 12. At point 3—3, tobacco begins to accumulate to form the upper half of the cylindrical rod. Belt 12 moves the tobacco from point 3—3 to point 4—4, with tobacco continually depositing in guide rails 62 between points 3—3 and 4—4.

Figure 4:
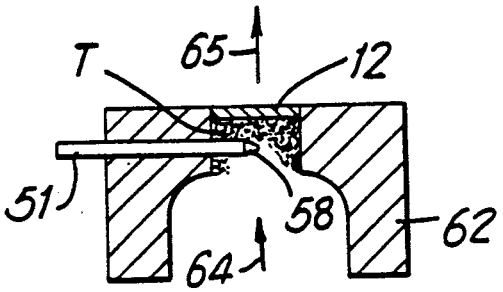
FIG. 4 is a cross-sectional view taken along line 4—4 of FIG. 2.

Referring now to FIGS. 2 and 4, at point 4—4 enough tobacco has accumulated to form a tobacco rod. One or more strands of liquid have been extruded from nozzle 58 to form a liquid stream in the tobacco rod. Belt 12 continues to transport the tobacco, now including at least one liquid strand, toward roller 14.

In the illustrative embodiment shown in FIG. 4, pipe 51, which carries the liquid extrudate, enters through the side of guide rails 62. Pipe 51 includes a ninety degree angle elbow, oriented such that nozzle 58 will extrude the liquid parallel to, and in the direction of, the travel of belt 12. Pipe 51 may be configured in any manner which will orient nozzle 58 to extrude material substantially in the center of the tobacco filler which lines guide rails 62.

At point 4—4, air continues to flow in the direction indicated by arrow 64, and through belt 12, as indicated by arrow 65. The flowing air causes the liquid extrudate to become impinged upon the tobacco. As the liquid is extruded and is subjected to the force of the air flowing through perforated belt 12, the liquid in the strands disperses slightly, filling gaps between the loose tobacco particles. Diffusion, wicking, and the forces applied to compress the rod also cause the liquid to disperse slightly.

To prevent the liquid from soaking through the tobacco, and thereby contacting the apparatus (e.g., belt 12), a high viscosity liquid must be used. Liquids acceptable for use according to this invention have a minimum viscosity of about 300 cP, depending upon the level of application (i.e., depending upon the weight of liquid added per weight of tobacco). The high viscosity of the liquid traps the liquid within the article, thereby preventing leaking of the liquid and staining of the cigarette paper, and preventing fouling of the cigarette maker and cigarette tipper.

Figure 5:
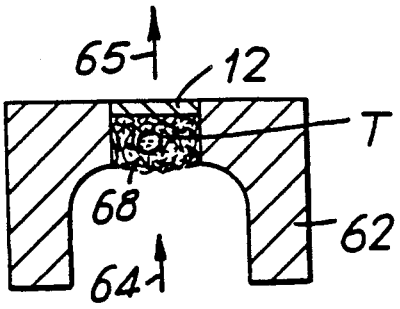
FIG. 5 is a cross-sectional view taken along line 5—5 of FIG. 2.

Referring to FIGS. 2 and 5, the liquid strand 68 is completely surrounded by tobacco at point 5—5. As belt 12 moves from point 4—4 to point 5—5, tobacco is continually added, forming a substantially cylindrical tobacco rod. Referring again to FIG. 1, the loose tobacco rod is then transported away from chimney 10, and any excess tobacco deposited in guide rails 62 is trimmed by trimmer knife assembly 18.

Figure 6:
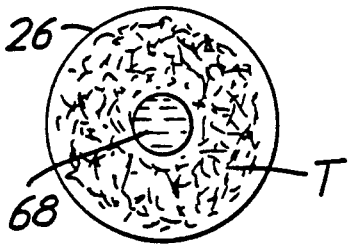
FIG. 6 is a cross-sectional view of the preferred embodiment of a cigarette made in accordance with this invention.
Figure 7:
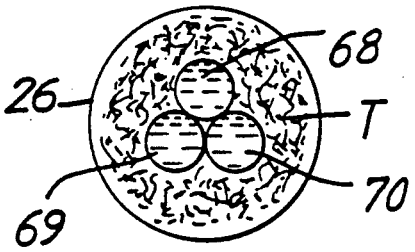
FIG. 7 is a cross-sectional view of an alternative embodiment of a cigarette made in accordance with this invention.

FIG. 6 shows an illustrative embodiment of a smoking article having a liquid strand 68 in accordance with the present invention. FIG. 6 is a cross-section of the smoking article taken along lines 6—6 of FIG. 1. The article has been compressed by the compression foot of short tongue 30. In this embodiment, only one flavor strand has been formed. In equally preferred embodiments, two or three liquid strands may be formed. Referring to FIG. 7, an alternate embodiment of a smoking article having three liquid strands 68, 69, and 70 is shown.

Figure 8:
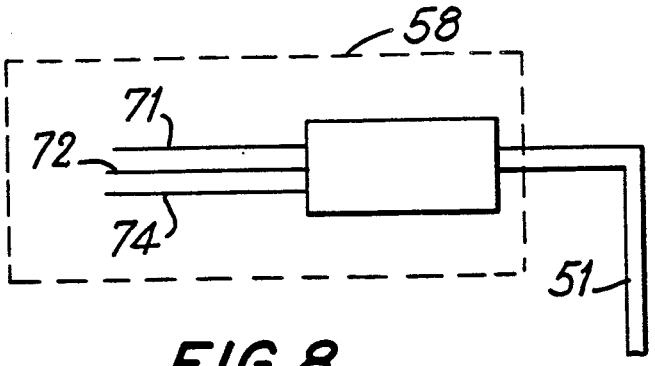
FIG. 8 is a side view of the nozzle apparatus used to extrude the liquid strands.

FIG. 8 shows an illustrative embodiment of nozzle 58 used in accordance with this invention. Nozzle 58 may include one or more heads. In the preferred embodiment, Nozzle 58 includes from one to three heads (71, 72, and 74). Preferably, each nozzle head is a hollow, needle-like structure, having a diameter of approximately 0.06 inches. The nozzle head is used to position the liquid strand on the tobacco as belt 12 moves on rollers 14 and 16. Dispersion causes the extruded liquid stream to expand to approximately 20 percent of the diameter of a cigarette. Multiple head nozzles may be used to control the amount of dispersion. Also, more than one flavorant or additive may be separately applied or coextruded.

When more than one flavorant or additive is separately applied, each liquid strand requires its own storage, pump, and piping apparatus. In an alternative embodiment, where more than one additive is to be applied, the additives may be stored separately, and then blended immediately prior to application.

Because the liquid strand remains in a relatively small cross-sectional area of the cigarette rod, the strand need not be disposed in the center of the rod. This reduces the precision required in manufacturing, because the strand need only be kept a sufficient distance from the edge of the rod to prevent staining the wrapper. The liquid strand may also be deliberately placed in a variety of positions with respect to the center so as to achieve a variety of combustion characteristics. In this way, a variety of smoke characteristics can be obtained.

Figure 9:
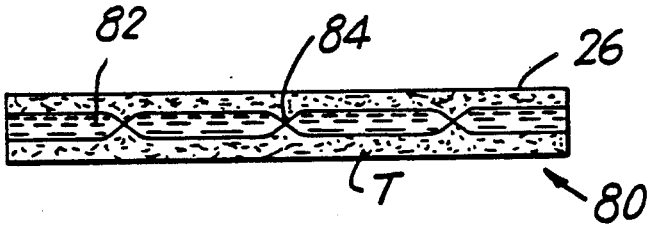
FIG. 9 is a longitudinal sectional view of an alternative embodiment of a cigarette having a liquid strand which varies in cross-sectional area.

FIG. 9 shows a longitudinal sectional view of an alternative embodiment of the invention in which the cross-sectional area of the liquid strand is varied down the length of the tobacco rod 80. In this embodiment, the liquid strand has a relatively larger cross-sectional area 82 at various predetermined points along the tobacco rod and a relatively smaller cross-sectional area 84 at other points. The larger and smaller cross-sectional areas may be disposed at any desired points within tobacco T along the length of rod 80.

Figure 10:
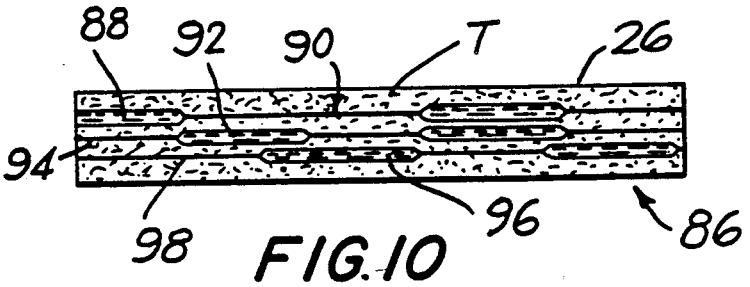
FIG. 10 is a longitudinal sectional view of an alternative embodiment of a cigarette having multiple liquid strands which vary in cross-sectional area.

Smoking article 86 of FIG. 10 includes a plurality of liquid strands disposed along the length of the rod. In this embodiment, the lengths of the three strands 88, 92, and 96 may be varied by the independent action of three pumps, each corresponding to the respective one of strands 88, 92, and 96. Strand 88 is created by modulating the operation of its corresponding pump. Liquid extrudate is applied to the rod when power is supplied to the pump. When power is not supplied, very little liquid, if any, is applied to the rod (indicated by reference numeral 90). By alternately supplying power to each of the respective pumps, liquid strands 88, 92, and 96 may be applied to the rod such that only a predetermined number of strands exist at any given point along the length of the rod. For example, power could be alternately supplied and disconnected, sequentially, to each of three pumps, each pump causing a different flavorant to be extruded. In this manner, a cigarette could be made having a first flavor in the first one-third of the rod, a second flavor in the second one-third of the rod, and a third flavor in the last one-third of the rod. In an alternative embodiment, the lengths of strands 88, 92, and 96 may be varied by throttling the flow of the materials forming each strand. In this embodiment, the operation of the pumps need not be modulated.

A variety of flavorants and other additives may be used to form the liquid strand. In the preferred embodiment, the liquid includes glucose menthyl-carbonate. An equally preferred additive is mono ammonium phosphate, which acts to retard the cigarette burn. Potassium citrate can be added to the liquid strand to accelerate the cigarette burn. Other conventional flavorants, burn inhibitors, burn accelerators, and smoke modifiers could be used.

Other materials may be added to alter the physical and/or chemical composition of smoke. For example, activated charcoal may be added to alter the gas phase delivery of the smoke. Because combustion varies across the cross-section of the cigarette (i.e., combustion in the center of the cigarette is different from combustion at the edges), the chemical composition of the liquid strand, and its positioning within the rod, both radially and longitudinally, may be varied to achieve different smoke characteristics.

Solid materials may be suspended within the liquid strand to form a slurry. For example, compounds such as menthol which are not highly soluble in water may be used in their solid form. In a similar manner, desirable gases could be trapped in the liquid strand or in heat-rupturable microcapsules in the strand. By applying additives which are only soluble in alcohol in the form of aqueous suspensions, the need for alcohol solvents is eliminated, thereby simplifying the manufacturing process.

In yet another embodiment of the invention, materials are added to cigarettes in pure form. The liquid strand itself is the flavorant. Materials also may be added to the tobacco as a paste, or may be extruded in semi-solid or solid form. The materials may be coextruded, with a first material surrounding a second material. The liquid strands could also be formed in a variety of patterns.

Although this specification describes the Mollins Company's MK9 Cigarette Maker and apparatus similar to the apparatus of U.S. Pat. No. 4,619,276, the liquid material may be applied to tobacco filler, or any suitable substitute in accordance with this invention, in virtually any commercially available cigarette making machine.

It will be understood that the foregoing is merely illustrative of the principles of the invention, and that various modifications can be made by those skilled in the art without departing from the scope and spirit of the invention. For example, the strands could contain colorants which indicate a "flavor center" to consumers.

We claim:

1. A method for forming cigarette rods having liquid strands comprising the steps of:

depositing tobacco onto a belt advancing in a predetermined direction;

extruding a liquid strand onto the deposited tobacco, said liquid strand having a cross-sectional area and a viscosity sufficient to prevent said liquid strand from soaking through the deposited tobacco; and depositing additional tobacco onto said belt so that said liquid strand is completely surrounded by tobacco, forming the cigarette rod.

2. The method of claim 1 wherein said liquid strand has a viscosity greater than about 300 cP.

3. The method of claim 2 wherein said liquid strand further comprises a slurry of solid particles.

4. The method of claim 2 wherein said liquid strand includes one or more materials selected from among the group consisting of tobacco flavoring materials, burn modifying materials, and smoke modifying materials.

5. A smoking article comprising:

a longitudinal tobacco rod; and at least one liquid strand, disposed within and along said tobacco rod, having a cross-sectional area and a viscosity sufficient to prevent said liquid strand from soaking through said tobacco rod.

6. The smoking article of claim 5 wherein said liquid strand has a viscosity greater than about 300 cP.

7. The smoking article of claim 5 wherein the cross-sectional area of said liquid strand varies at predetermined points along said longitudinal tobacco rod.

8. The smoking article of claim 5 wherein said smoking article comprises a plurality of liquid strands, each having a cross-sectional area, said strands being disposed within and along said tobacco rod.

9. The smoking article of claim 8 wherein the cross-sectional area of each liquid strand varies at predetermined points along said longitudinal tobacco rod.

10. The smoking article of claim 8 wherein at least one of said plurality of liquid strands includes different material than one of the other strands.

11. The smoking article of claim 5 wherein said liquid strand includes one or more materials selected from among the group consisting of tobacco flavoring materials, burn modifying materials, and smoke modifying materials.

12. The smoking article of claim 11 wherein said tobacco flavoring material is glucose menthyl-carbonate.

13. The smoking article of claim 11 wherein said burn modifying material is a burn-inhibitor.

14. The smoking article of claim 13 wherein said burn-inhibitor is monoammonium phosphate.

15. The smoking article of claim 14 wherein said liquid strand includes solid particles forming a slurry.

16. The smoking article of claim 15 wherein said solid particles are menthol crystals.

17. The smoking article of claim 15 wherein said solid particles are activated charcoal.

18. The smoking article of claim 11 wherein said burn modifying material is a burn-accelerator.

19. The smoking article of claim 18 wherein said burn-accelerator is potassium citrate.

20. A method for forming cigarette rods having a liquid strands comprising the steps of:

depositing tobacco onto a belt advancing in a predetermined direction;

extruding a liquid strand onto the deposited tobacco, said strand having a cross-sectional area and a viscosity greater than about 300 cP;

selectively varying the rate at which said liquid strand is extruded so that said cross-sectional area varies at predetermined points along the length of said liquid strand; and depositing additional tobacco onto said belt so that said liquid strand is completely surrounded by tobacco, forming the cigarette rod.

21. A method for forming cigarette rods having liquid strands comprising the steps of:

depositing tobacco onto a belt advancing in a predetermined direction;

co-extruding a first liquid strand and at least one additional liquid strand onto the deposited tobacco, each strand having a cross-sectional area and a viscosity greater than about 300 cP; and depositing additional tobacco onto said belt so that said liquid strands are completely surrounded by tobacco, forming the cigarette rod.

22. The method of claim 21 further comprising the step of selectively varying the rate at which each of the liquid strands is extruded, such that the cross-sectional area of each strand varies at selected points along each of the respective strands.

23. A smoking article comprising:

a longitudinal tobacco rod; and a plurality of liquid strands, each strand having a cross-sectional area and a viscosity sufficient to prevent said liquid strand from soaking through said tobacco rod, said strands being disposed within and along said tobacco rod, and wherein the cross-sectional area of at least one liquid strand is reduced such that very little liquid is disposed at predetermined points along said tobacco rod.

* * * * *